United States Patent [19]

Pellegri

[11] 4,308,124

[45] Dec. 29, 1981

[54] APPARATUS FOR ELECTROLYTIC PRODUCTION OF ALKALI METAL HYPOHALITE

[75] Inventor: Alberto Pellegri, Luino, Italy

[73] Assignee: Oronzio de Nora Impianti Elettrochimici S.p.A., Milan, Italy

[21] Appl. No.: 156,352

[22] Filed: Jun. 4, 1980

Related U.S. Application Data

[62] Division of Ser. No. 50,143, Jun. 19, 1979, Pat. No. 4,240,884.

[30] Foreign Application Priority Data

Feb. 15, 1979 [IT] Italy ..... 20232 A/79

[51] Int. Cl.[3] ..... C25B 9/00

[52] U.S. Cl. ..... C25B 9/00; C25B/1/24

[58] Field of Search ..... 204/95, 252–258, 204/263–266

[56] References Cited

U.S. PATENT DOCUMENTS

| | | | |
|---|---|---|---|
| 2,014,148 | 9/1935 | Sievert | 204/263X |
| 2,183,299 | 12/1939 | Stuart | 204/266 |
| 2,695,874 | 11/1954 | Zdansky | 204/258 |
| 4,062,753 | 12/1977 | Falvo | 204/252 X |
| 4,135,996 | 1/1979 | Bouy et al. | 204/252 X |
| 4,142,950 | 3/1979 | Creamer et al. | 204/266 X |
| 4,221,642 | 9/1980 | De Nora et al. | 204/252 X |

FOREIGN PATENT DOCUMENTS

| | | | |
|---|---|---|---|
| 51-18996 | 2/1976 | Japan | 204/252 |

*Primary Examiner*—Andrew Metz
*Assistant Examiner*—Donald R. Valentine
*Attorney, Agent, or Firm*—Hammond & Littell, Weissenberger and Muserlian

[57] ABSTRACT

A process and an apparatus for producing alkali metal hypohalite by passing an alkali metal brine solution through the anode compartment of an electrolytic cell in which the anode compartment and the cathode compartment are separated by a fluid impervious, anion-permeable membrane, providing an aqueous support catholyte into the cathode compartment, impressing an electric potential across the anode and cathode to evolve halogen at the anode and hydrogen at the cathode and recovering alkali metal hypohalite from the anode compartment.

2 Claims, 2 Drawing Figures

APPARATUS FOR ELECTROLYTIC PRODUCTION OF ALKALI METAL HYPOHALITE

Figure 1:
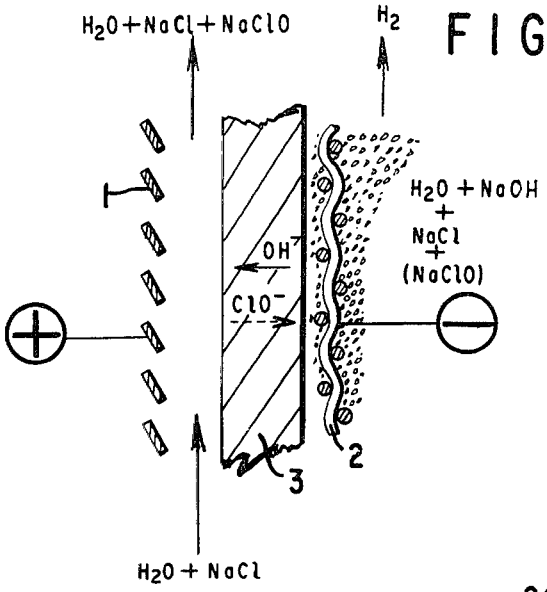

This is a division of Ser. No. 50,143, filed June 19, 1979 now U.S. Pat. No. 4,240,884.

BACKGROUND OF INVENTION AND PRIOR ART

According to known methods, alkali metal hypohalites may be produced by electrolysis of an alkali metal brine (e.g. sodium chloride) in diaphragmless electrolysis cells in which the electrolyte is flowed one or more times through a series of cells having anodes and cathodes between which the alkali metal brine is electrolyzed. The halogen (e.g. chlorine) is discharged at the anode according to the reaction:

$$2Cl^- \rightarrow Cl_2 + 2e^-$$

while water is reduced at the cathode with evolution of hydrogen and formation of sodium hydroxide according to the reaction:

$$2Na^+ + 2H_2O + 2e^- \rightarrow 2NaOH + (H_2)\uparrow$$

The halogen (e.g. chlorine) reacts with the alkali metal hydroxide to form hypochlorite according to the reaction:

$$Cl_2 + NaOH \rightarrow NaClO + NaCl + H_2O$$

The sodium hypochlorite dissolved in the solution may react to form hypochlorous acid, according to the equilibrium:

$$NaCl + H_2O \rightleftharpoons HClO + Na^+ + OH^- \quad (1)$$

The hypochlorous acid, in turn, partially dissociates into hydrogen ions and hypochlorite ions according to the equilibrium:

$$HClO \rightleftharpoons H^+ + ClO^- \quad (2)$$

The equilibrium constant of both reactions (1) and (2) depends upon the pH of the solution. For example, at pH values less than 5, all of the active chlorine is present as hypochlorous acid and hypochlorite ions whereas at high pH values, nearly all the active chlorine is present as hypochlorite ions. Therefore, active chlorine concentration is usually referred to, although it comprises molecular chlorine, hypochlorous acid and hypochlorite ions.

In the electrolysis cells used for generating hypochlorite solutions, the pH of the solution is usually kept above 7.5 so that nearly all the active chlorine is present as hypochlorite ions. Moreover, the temperature is kept low enough (generally lower than 35° C.) to prevent dismutation of hypochlorite to chlorate and the brine is rather dilute and generally contains from 20 to 40 gpl of chloride ions with sea water often being used as the electrolyte. The concentration of active chlorine (that is hypochlorite ions) in the effluent is generally lower than 2–3 gpl.

Higher concentrations of hypochlorite are possible only at a cost of prohibitive current efficiency losses. In fact, the cathodic reduction of hypochlorite to chloride is favored over the reduction of water from a thermodynamical standpoint and therefore, it is highly competitive with respect to hydrogen evolution. With known cells, the practical maximum hypochlorite concentration cannot be higher than 8–10 gpl. Beyond these limits, the current efficiency comes to naught since the hypochlorite ions are reduced at the cathode as fast as they are formed.

The most serious problem in the known cells for direct sea water chlorination, or chlorination of brines prepared from raw salts and water stems from the fact that calcium and magnesium, and to a lesser degree other alkaline earth metal and alkali metals, which are always present in large amounts as impurities in raw salt or in sea water, precipitate as hydroxides on the cathodes generating scale thereon which before long fills the interelectrodic gap. Periodic washing of the cells with acidic solutions, such as hydrochloric acid solutions, is the only effective way of maintaining a continuous operation and such washings are carried out at regular intervals, varying from some days to one or more weeks depending on the quality of the salt used and/or the operating conditions of the plant.

In plants with a power production above a certain minimum, a fixed, integrated washing system is provided and fixed washing systems, besides obvious complications and additional expense costs for a chlorination plant, require the choice of suitable materials which are non-corrosive to the washing agents used. For example, the cathodes must be made of materials sufficiently resistant to hydrochloric acid to withstand frequent washings and the use of titanium or other valve metal cathodes is common practice which obviously entails higher costs and a higher hydrogen overvoltage. Moreover, repeated acid washings reduce the average operating life time of titanium anodes coated with a surface layer of electrocatalytic, non-passivatable materials. The titanium base, in fact, tends to lose its electrocatalytic coating as a result of the acid attacks which produces corrosion thereof.

In alkali metal chlorate production, electrolytic cells similar to those used in producing hypochlorite are utilized, but the working conditions are such that the dismutation of hypochlorite and/or hypochlorous acid to chlorate is favored whereby the current efficiency loss due to cathodic reduction of hypochlorite is reduced. Therefore, the temperature of of the electrolyte is kept around 60°–90° C. and the pH is kept below 3–4 by adding hydrochloric acid. The electrolyte flows in a circuit comprising the electrolysis cell and a holding tank to reduce the residence time within the cell and to allow hypochlorite dismutation to chlorate in the holding tank before feeding the electrolyte back into the cell.

In both instances, means are used to prevent the hypohalite generated within the solution from diffusing towards the cathode. For example, the solution is passed through the cell at a high speed with a short residence time therein while keeping the flow of electrolyte between the electrodes as laminar as possible and then into a holding tank. The hydrogen bubbles present in the electrolyte produce a certain turbolence, especially in proximity to the electrodes, which enhances the diffusion of the hypohalite ions towards the cathode by convective mass transfer.

Although brine electrolysis is a highly advanced technical field of great industrial importance and a constant research effect is exerted and wherein the importance of technical improvements is substantial, the process of the present invention has never been practiced nor have the advantages therefrom been secured.

OBJECTS OF THE INVENTION

It is a primary object of the present invention to provide an improved electrolytic process and an improved electrolysis cell for producing oxygenated halogen compounds, particularly alkali metal hypochlorites.

It is a further object of the invention to provide a novel process and an electrolysis cell therefor for halogenating bodies of water whereby scaling of cathodes by alkaline earth metal precipitates is avoided.

These and other objects and advantages of the invention will become apparent from the following detailed description.

THE INVENTION

The improved process of the invention for producing alkali metal hypohalite solutions by electrolysis of alkali metal halide solutions comprises passing an aqueous alkali metal halide solution through the anode compartment of an electrolytic cell having an anode compartment with an anode therein and a cathode compartment with a cathode therein separated by a fluid-impervious, anion-permeable membrane, providing an aqueous support electrolyte in the cathode compartment, applying an electric potential across the cell sufficient to evolve halogen at the anode and reduce water at the cathode and recovering an aqueous alkali metal hypohalite solution from the anode compartment. The hydrogen evolved at the cathode may be vented from the cathode compartment or recovered therefrom.

The supporting aqueous catholyte fed to the cathode compartment preferably consists of an aqueous solution of an alkali metal base such as, for example, an alkali metal hydroxide or carbonate. On starting up the electrolysis process, the cathode compartment thereof may be flooded with the same aqueous alkali metal halide solution as that used as the electrolyte in the anode compartment. Whether an alkali metal hydroxide or carbonate solution or an alkali metal halide solution is used at the start of the process, the electrolytic system soon reaches an equilibrium condition and the composition of the supporting catholyte solution becomes constant.

When an alkali metal hydroxide solution is initially fed to the cathode compartment, the halide ions from the anode compartment migrate through the membrane to form alkali metal halide in the catholyte, until the halide concentration therein reaches such a value to equalize the osmotic pressure differential on the opposite surfaces of the membrane. At this point, the hydroxide ion flow through the membrane from the cathode compartment to the anode compartment is reduced to the equilibrium value corresponding to the electric current passing through the cell. Conversely, when the same aqueous alkali metal halide solution as that fed to the anode compartment is initially fed to the cathode compartment, the halide ions migrate during the first few minutes of operation from the catholyte to the anolyte across the membrane, and alkali metal hydroxide is formed in the catholyte.

When the hydroxide ion concentration in the catholyte reaches the steady state value, the hydroxide ion flow throughout the membrane reaches the equilibrium value corresponding to the electric current passing through the cell. In a continuous operation, the catholyte level is kept constant by adding sufficient water to make up for the losses. The added water is preferably demineralized or freed of calcium, magnesium and other alkaline earth metals.

During the process as previously noted, chlorine evolution takes place at the anode and hydrogen evolution occurs at the cathode as a result of water electrolysis in the cathode compartment. The hydroxide ions generated at the cathode migrate through the anion-permeable membrane to quantitatively react with halogen in the anolyte to produce the alkali metal hypohalite. The electrolysis current through the anion-permeable membrane is substantially carried by the hydroxide ions passing through the membrane from the catholyte to the anolyte.

The anion-permeable-membrane is substantially impermeable to cations so that migration of cationic impurities such as calcium and magnesium towards the cathode is effectively prevented. Therefore, the anolyte may contain high amounts of calcium, magnesium and other cationic impurities without creating a problem at the cathodes which are thereby effectively protected against scaling. This permits impure brines to be used without complicating the process or requiring acid washing of the cathodes.

Another advantage over the use of diaphragmless cells is the absence of gaseous phases in the halide solution circulated through the anode compartment which is particularly advantageous in plants used for chlorinating cooling waters since degassing towers or tanks to separate the hydrogen from the chlorinated water are not required resulting in savings in capital expenditures. The hydrogen produced in the cathode compartment is easily recovered from the cathode compartment through a vent.

The use of the fluid impervious, anion-permeable membranes also favorably affects the current efficiency of the process as there is less tendency for the hypohalite ions to be cathodically reduced. Tests have shown that the membranes, though permeable to the hypohalite ions, exert a kinetic hindrance with reference to hypohalite ion diffusion which takes place in diaphragmless cells. The membrane in practice excludes the convective transfer of the hypohalite ions towards the cathode which probably accounts for the increase in current efficiency of the process of the invention over the process in diaphragmless cells. Moreover, the aqueous support catholyte used in the process does not require continuous replacement or any treatment except addition of small amounts of water to maintain the catholyte level during operation.

Moreover, the use of an aqueous support catholyte permits the use of film forming agents such as alkali metal chromate and dichromate in the catholyte which, when added in small amounts of 1 to 10 g/l, have the property of generating a stable cathodic film on the cathode as the result of the precipitation of insoluble compounds in the alkaline layer of the catholyte adjacent to the surface of the cathode. Such a film effectively prevents hypohalite ions from diffusing through the film and being reduced at the cathode, moreover the film does not cause any appreciable ohmic polarization. For example, when 1 to 7 g/l of sodium dichromate is added to the catholyte, the current efficiency increases by at least 3%. The increase of faradic yield allows higher hypohalite concentrations in the anolyte without any dramatic current efficiency reduction which occurs in traditional diaphragmless cells. As will be seen from the examples, a hypohalite concentration of about 8 g/l was obtained in the anolyte with a current efficiency greater than 80%.

The alkali metal halide solution flowed through the anode compartment may contain from as low as 10 g/l of the halide up to the saturation value, preferably 25 to 100 g/l, depending upon the eventual use of halogenated solution. In water chlorination plants for the suppression of biological activity, for example, in biocidal treatment of cooling waters or pool waters, the alkali metal chloride solution may be seawater or synthetic brine containing from 10 to 60 g/l of sodium chloride. The temperature in the cell is normally lower than 30°-35° C. to prevent hypochlorite dismutation to chlorate.

Referring now to the drawings:

FIG. 1 schematically illustrates the electrolytic process taking place within the cell.

Figure 2:
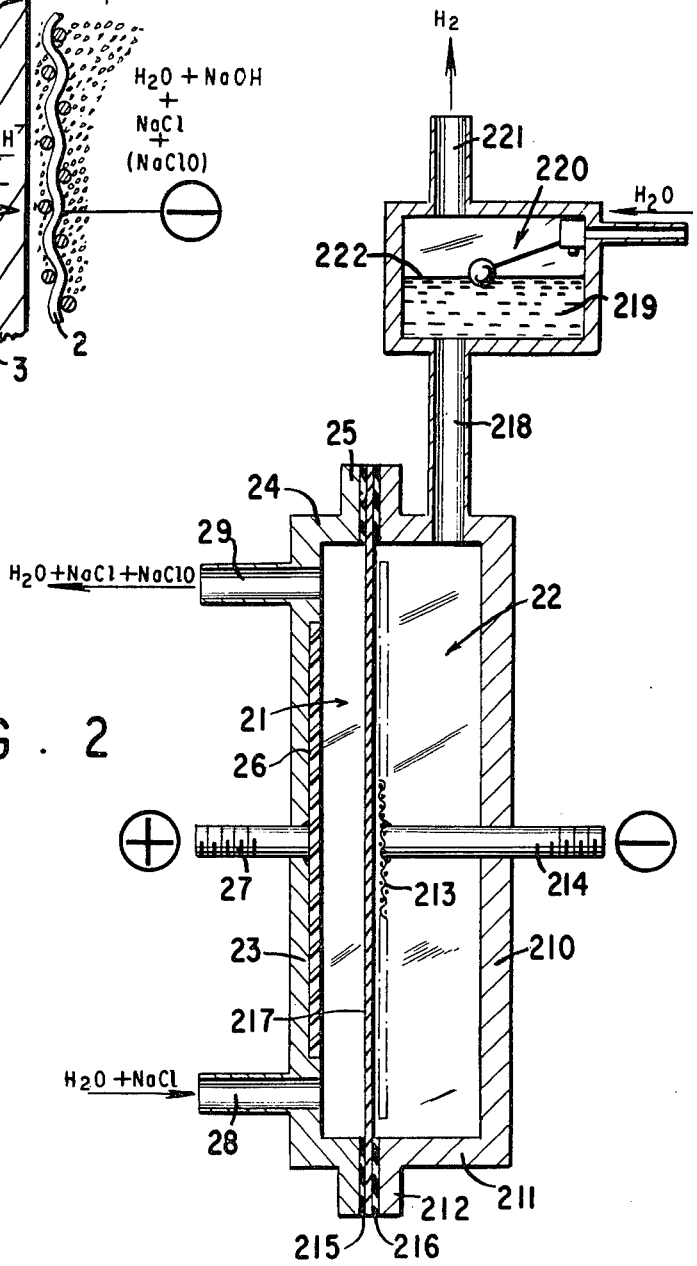

FIG. 2 is a schematic cross-section of a preferred embodiment of a single electrolysis cell.

For the sake of clarity, only a single monopolar electrolysis cell used for electrolysis of sodium chloride to produce NaClO is illustrated. However, as will be obvious to one skilled in the art, the invention involves broader applications and the use of multiple cells in series, or bipolar cells which result in advantages in plant construction and operation.

Referring to FIG. 1, the electrolytic process for producing sodium hypochlorite is effected with an anode 1, a cathode 2 and a fluid-impervious, anion-permeable membrane 3. Anode 1 may consist of any normally used anodic material such as valve metals like titanium coated with an electrocatalytic coating of oxides of noble metals and valve metals as described in U.S. Pat. Nos. 3,711,385 and 3,632,498 and cathode 2 may consist of a screen of steel, nickel or other conducting material with a low hydrogen overvoltage. Anode 1 and cathode 2 are respectively connected to the positive and the negative pole of a direct current source.

Membrane 3 may be chosen from any number of commercially available fluid-impervious, anion-permeable membranes, which are chemically resistant to both the anolyte and catholyte, and exhibit a low ohmic drop. The membrane must be impervious to fluid flow and substantially impermeable to cations. Particularly suitable anionic membranes produced by Ionac Chemical Co.—Birmingham N.J. are marketed by Sybron Resindion, Milan, Italy, under the designation MA-3475.

In steady state operation, the supporting catholyte as shown in FIG. 1 consists essentially of a dilute aqueous solution of sodium hydroxide and a small amount of sodium chloride and contacts cathode 2 and the cathode side of anionic membrane 3. The sodium hydroxide concentration in the catholyte may range between 10 and 100 g/l, depending upon the current density and the type of anionic membrane used. The sodium chloride concentration is slightly lower than it is in the anolyte solution circulated through the anode compartment in contact with anode 1 and the anodic side of membrane 3.

By applying a sufficiently high electric voltage (e.g. 4 to 4.5 V) between the anode and the cathode, an electrolysis current flows through the cell to evolve chlorine at the anode surface and hydrogen at the cathode surface. The hydrogen evolved at the cathode bubbles through the catholyte and catholyte head and is recovered through a vent. The hydroxide anions migrate through the membrane from the catholyte to the anolyte to react therein with chlorine to produce sodium hypochlorite in the anolyte which is recovered as a dilute solution effluent from the anodic compartment.

Hypochloride ions tend to diffuse through the membrane towards the catholyte under the net driving force resulting from the opposing effects of the difference in concentration existing between the anolyte and the catholyte and the electrical field existing across the anionic membrane. In steady state operation, a certain concentration of hypochlorite is present in the catholyte but the concentration in the catholyte seldom exceeds 30% of the average hypochlorite concentration in the anolyte.

The determining factor for current efficiency loss due to hypochlorite cathodic reduction is the diffusion rate of hypochlorite ions through the so-called cathodic double layer. The absence of convective transfer and the hinderance which the membrane exerts against hypochlorite ion migration provides a lower hypochlorite concentration in the bulk of the catholyte thereby reducing the diffusion rate of hypochlorite through the cathodic double layer even though high hypochlorite concentration in the anolyte is used. However, even with a substantially reduced concentration of hypochlorite in the catholyte, a small current efficiency loss occurs due to the unavoidable cathodic reduction of hypochlorite ions adjacent the cathode surface after migrating through the cathodic double layer.

The current efficiency loss may be further reduced by adding film forming agents to the catholyte, such as, for example, sodium chromate or dichromate. These salts may be added to the catholyte in an amount varying from 1 to 7 g/l. Their effect is to generate a stable film in the cathodic double layer due to the precipitation of insoluble chromium compounds in the alkaline layer of electrolyte adjacent the cathode surface. Said film acts as a barrier against the hypochlorite ions diffusion towards the cathode surface.

The cell temperature is preferably kept below 35° C. to prevent hypochlorite dismutation to chlorate in the anolyte. The anodic solution may be recycled one or more times through the anode compartment and through an external tank in parallel connnection with the anolyte compartment depending on the hypochlorite concentration desired in the effluent solution.

In FIG. 2, which illustrates a diagrammatic embodiment of a suitable apparatus for practicing the process of the invention, an electrolysis cell is provided consisting of an anode compartment 21 and a cathode compartment 22. The anode compartment consists of an end plate 23 and a frame 24 provided with an external flange 25. The anode compartment is thus box-shaped with a thickness of several millimeters, preferably 2 to 4 mm. It is preferably made of polyvinylchloride but it may be made of any other inert and electrically insulating resin material, or it may be made of titanium or other valve metals, or steel suitably coated with epoxy resin or with other inert material.

An anode 26, preferably made of titanium activated with an electrocatalytic coating of a valve metal oxide-ruthenium oxide is fixed to end plate 23 and a terminal 27 connected to the positive pole of a direct current generator extends through the end plate 23. Anode 26 is preferably fixed in a recess provided in the end plate 23 so that the electrolyte flowing through the anode compartment flows along a substantially flat surface. Preferably, a sealing agent is used to secure anode 26 in the recess during the assembly of the cell. The anode compartment 21 is provided with an inlet 28 and an outlet 29 for the anolyte circulation therethrough.

The cathode compartment 22 is substantially similar to the anode compartment and comprises an end plate 210, a frame 211 provided with an external flange 212. The cathode compartment may be made of the same or different material than that used for the anode compartment. A cathode 213, preferably made of a steel or nickel screen or expanded sheet, is secured in a position substantially co-planar with the plane of flange 212. The cathode is connected to the negative pole of the direct current generator by terminal 214 which passes through the end plate 210.

A pair of insulating neoprene gaskets 215 and 216 are placed on the flanges 215 and 212 of the anode and the cathode compartment, respectively. A fluid-impervious, anion-permeable membrane 217 is positioned between the neoprene gaskets 215 and 216 in a parallel relationship with respect to anode 26 and cathode 213. Membrane 217 spans the entire open area of the two compartments 21 and 22, and separates anode 26 from cathode 213 thereby defining the respective anode and cathode compartments. A vertical pipe 218 connects the upper part of the cathode compartment to a tank or reservoir 219, provided with a float valve 220, by which the catholyte head is kept constant, and an outlet 221 for venting the cathodic gas.

During operation of the cell, the cathode compartment and the tank 219 are kept filled to level 222 of tank 219 with a solution of alkali metal chloride or other suitable support electrolyte such as an alkali metal hydroxide or carbonate, preferably containing 1 to 7 g/l of an alkali metal dichromate. Alkali metal chloride solution is introduced into the anode compartment through inlet 28 and a solution is recovered from outlet 29 containing the hypochlorite generated by the electrolytic process. The hydrogen evolved at cathode 213 bubbles through the catholyte and leaves the cell through vent 221. Preferably, a hydrostatic pressure slightly higher than the pressure generated by the catholyte head is maintained in the anode compartment so that the membrane 217 is slightly pressed towards the adjacent cathode. The anolyte may be recycled one or more times through the anode compartment of FIG. 2 or a plurality of cells similar to FIG. 2 may be connected in series so that the anolyte flows through the connected cells to provide a greater concentration of hypochlorite in the anolyte effluent.

In the following example there are described several preferred embodiments to illustrate the invention. However, it is to be understood that the invention is not intended to be limited to the specific embodiment.

EXAMPLE 1

A cell made of polyvinylchloride similar to the one illustrated in FIG. 2 was used in the test. The anode consisted of a titanium metal sheet coated with a layer of mixed oxides of valve metal, titanium oxide, and a platinum group metal, ruthenium dioxide, and the cathode consisted of a stainless steel screen. The fluid-impervious anion-permeable membrane was of the MA 3475 type marketed by Sybron Resindion of Milan, Italy. The cathode compartment was flooded with an aqueous solution containing 40 g/l of sodium chloride and 2 g/l of $Na_2Cr_2O_7$.

A brine containing 30 g/l of sodium chloride and about 110 ppm of calcium and 70 ppm of magnesium was continuously circulated through the anode compartment of the cell connected in parallel to a recycling tank. The effluent solution from the anode compartment was withdrawn at the outlet of the anode compartment and collected in a tank. A variable delivery pump was used to vary the recycling ratio from 2 to 20, that is varying 10 fold the speed of the anolyte through the anode compartment, with the same rate of withdrawal of the effluent solution. The electrolyte temperature was kept between 14° and 25° C. during the duration of the tests.

The results of operation are reported in Table I.

TABLE I

| Recycling ratio | Temperature °C. | Current density A/m² | Cell Voltage V | Effluent Hypochlorite Concentration g/l | Current Efficiency % |
|---|---|---|---|---|---|
| 2 | 16 | 1000 | 4.5 | 1 | 93 |
| 4 | 17 | 1000 | 4.5 | 2 | 91 |
| 6 | 19 | 1000 | 4.3 | 3.5 | 90.5 |
| 10 | 20 | 1000 | 4.2 | 4.2 | 90 |
| 15 | 22 | 1000 | 4.4 | 5.0 | 87 |
| 15 | 22 | 1000 | 4.1 | 5.6 | 84 |
| 20 | 25 | 1000 | 4.1 | 7.2 | 82 |
| 20 | 25 | 1000 | 4.3 | 8 | 81 |

After a 250 hours run, the results had not appreciably changed, and both the membrane and the cathode were free from scale.

Various modifications of the process and cell of the invention may be made without departing from the spirit or scope thereof and it should be understood that the invention is to be limited only as defined in the appended claims.

We claim:

1. An electrolysis cell for producing an alkali metal hypohalite solution by electrolysis of an alkali metal halide solution comprising an anode compartment containing an anode, a cathode compartment containing a cathode, a fluid-impervious, anion-permeable membrane hydraulically separating said compartments, means for maintaining an aqueous support catholyte in the cathode compartment in contact with the side of the cathode facing the said membranes, means for passing an alkali metal halide solution through said anode compartment, means for impressing an electrolysis current across the cell, means for recovering the alkali metal hypohalite solution effluent from said anode compartment, and means for removing hydrogen from said cathode compartment, the cathode compartment being connected to an overhead catholyte reservoir containing aqueous support catholyte to maintain the catholyte head pressure.

2. The electrolysis cell of claim 1 in which the catholyte support reservoir is provided with automatic means to maintain the desired level of catholyte aqueous support liquid therein.

* * * * *